US005441356A

United States Patent [19]

Cho

[11] Patent Number: 5,441,356

[45] Date of Patent: Aug. 15, 1995

[54] CAP FOR WRITING DEVICE

[76] Inventor: Cheong K. Cho, #1001-2 Doksan-Dong Guro-Ku, Seoul, Rep. of Korea

[21] Appl. No.: 402,139

[22] Filed: Mar. 10, 1995

[51] Int. Cl.[6] ..... B43K 9/00

[52] U.S. Cl. ..... 401/247; 401/202; 401/213; 401/243

[58] Field of Search ..... 401/202, 213, 243, 247

[56] References Cited

U.S. PATENT DOCUMENTS 4,844,642 7/1989 Inaba et al. ..... 401/247 X
5,154,526 10/1992 Bothe .
5,176,460 1/1993 Garry .
5,336,011 8/1994 Ferguson et al. .

*Primary Examiner*—Steven A. Bratlie

[57] ABSTRACT

A cap for a writing device which prevents drying of ink within a given writing device comprises a cap having a ventilating hole at the leading end thereof, an inner cap formed within the cap and having a ventilating hole at the leading end thereof, a spring room and a valve room formed within the inner cap, a valve cap having longitudinal channels and a deep recess and installed to open and close the ventilating hole by the help of a spring, and an annular step formed on the opening side of the inner cap for preventing the departure of the valve cap, whereby the valve cap blocks the ventilating hole upon coupling of a writing pen body to the cap to prevent a pressure variation within the cap and to prevent the evaporation-drying of the ink.

5 Claims, 3 Drawing Sheets

SECTION A–A

SECTION B–B

CAP FOR WRITING DEVICE

BACKGROUND OF THE INVENTION

1. Field of the Invention

The present invention generally relates to a cap for a writing device and particularly to a protective cap for a writing device utilizing aqueous ink.

2. Background of the Invention

Cap of conventional writing device using aqueous ink typically has an inner cap which is made of soft material. Thus, when the writing device is coupled with the cap, the inner cap is abutted against the leading end of the writing device so as to prevent drying of the ink. However, during the process of coupling of the writing device with the cap, air within the cap is compressed—thereby increasing the internal pressure of the cap. When the cap is detached from the writing device, the air pressure within the cap is abruptly decreased—resulting in the ink in the writing tip of the writing device being forcibly discharged and evaporated. As the cap is alternately coupled and detached with and from the writing device during its normal use, a significant amount of the ink is wasted in a given pen during its given lifetime.

The prior art discloses cap with writing instruments of various designs and means.

U.S. Pat. No. 5,336,011 to Ferguson et al. discloses a storage cap with spring biased female threads for a rod-shaped device or instrument, particularly a fountain pen, wherein the female threads for securing the device within the cap are disposed within an axially and rotationally moveable ring.

U.S. Pat. No. 5,176,460 to Garry discloses a pen cap for a writing instrument barrel comprising a chamber defining inner housing adapted to snugly receive a reduced nib carrying portion of the barrel and a spaced flow-through outer housing coextensive at the proximal end thereof with the inner housing to define a narrow passage therebetween with spaced radially extending rib members extending thereacross between the spaced inner and outer housing to strengthen the pen cap at the proximal end thereof.

U.S. Pat. No. 5,154,526 to Bothe discloses a protective cap for capillary writing instruments comprised of a relatively flexible outer casing and a relatively rigid inner casing. One end of outer casing is adapted to form a substantially fluid tight seal on the body of a writing instrument. A flexible sealing means, e.g., spherical, is positioned between the inner sheath and the outer sheath so as to form a substantially fluid tight seal on the tip of a writing instrument inserted into the inner casing and placed in contact with the sealing means.

Although these prior arts disclose caps for writing instruments of various designs and means, none of them disclose a cap for writing device of the particular structure and novelty as disclosed and claimed hereinafter.

It is thus a primary objective of the present invention to provide a cap for writing device which prevents sudden pressure variations within the cap.

Another objective of the present invention is to provide a cap for writing device which prevents drying of ink of the writing device.

Yet another objective of the present invention is to provide a cap for writing device which prevents evaporation-drying of ink of the writing device.

SUMMARY OF THE INVENTION

The present invention is characterized in that air can flow in and out through a ventilating hole of an outer cap and through a ventilating hole of an inner cap. A valve cap for closing and opening the ventilating hole of the inner cap is movably disposed within the inner cap as is a spring so as to prevent the discharge and evaporation of the ink during detachment of the writing device from the cap by having the valve cap open the ventilating hole through actuation of the spring. During coupling of the writing device with the cap, the valve cap is pushed inward by the writing device so as to discharge the internal air out through the ventilating hole. Furthermore, the present invention prevents the stepping-up of the internal pressure whereby, when the writing device is coupled with the cap in a perfect manner, the ventilating holes are closed with the lower end of the valve cap abutting with the leading end portion of the writing device so as to prevent drying of the ink in the writing device. Therefore, the cap of the present invention possesses novelty not present in conventional caps.

These together with other objects of the invention are pointed out clearly in the claims annexed to and forming a part of this disclosure. For a better understanding of the present invention, its operating advantages and the specific objects attained by its use, references should be made to the accompanying drawings and descriptive matter in which there are illustrated preferred embodiments of the invention.

BRIEF DESCRIPTION OF THE DRAWINGS

The above objects and other advantages of the present invention will become more apparent by describing in detail the preferred embodiment of the present invention with references to the attached drawings in which.

DESCRIPTION OF THE PREFERRED EMBODIMENTS

Figure 1:
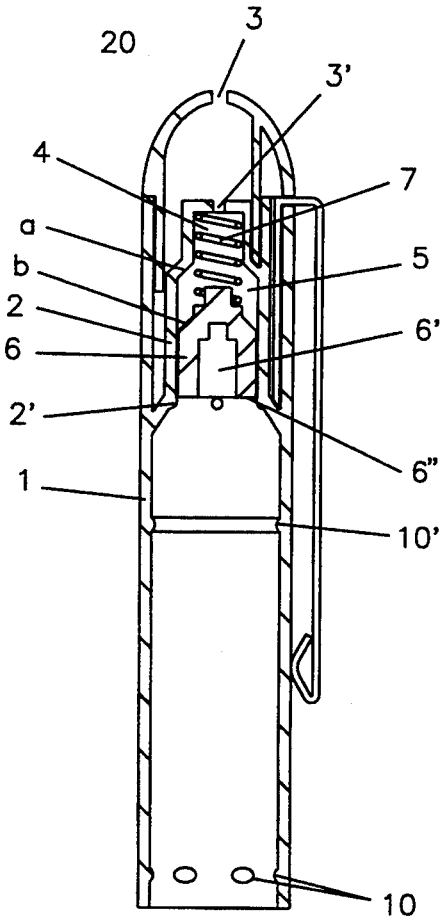
FIG. 1 is a sectional view of the cap according to the present invention.
Figure 2:
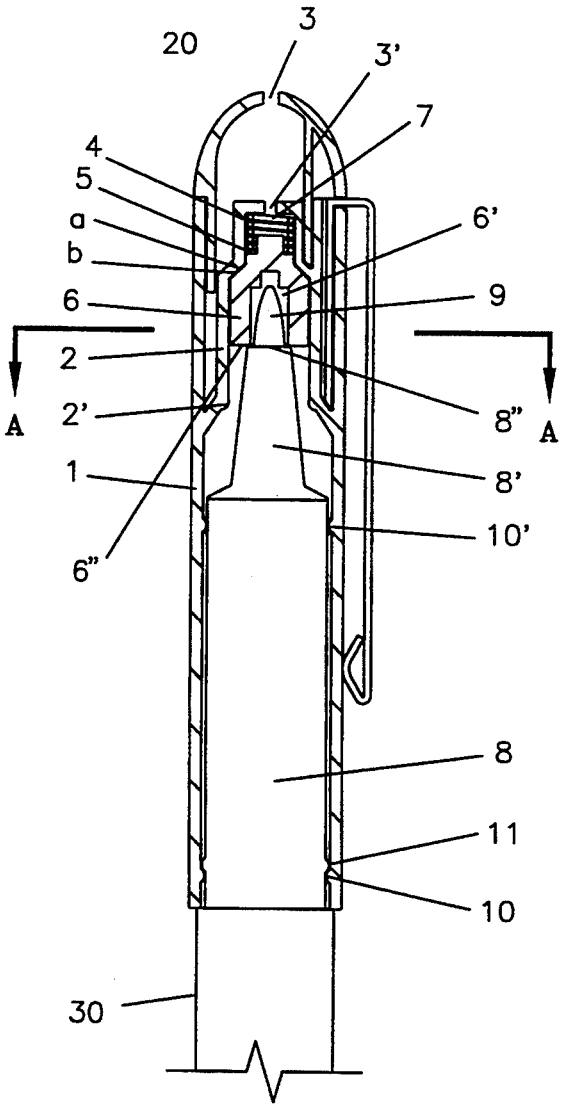
FIG. 2 is a sectional view of the cap showing a state of coupling between the cap and a writing pen body.
Figure 5:
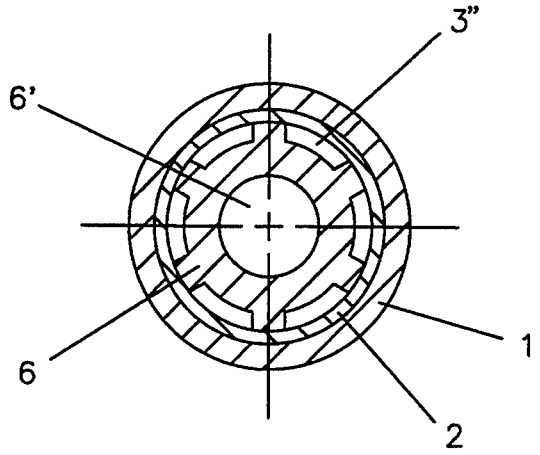
FIG. 5 is a sectional view of the cap taken along a line A—A of FIGS. 2 and 4.
Figure 6:
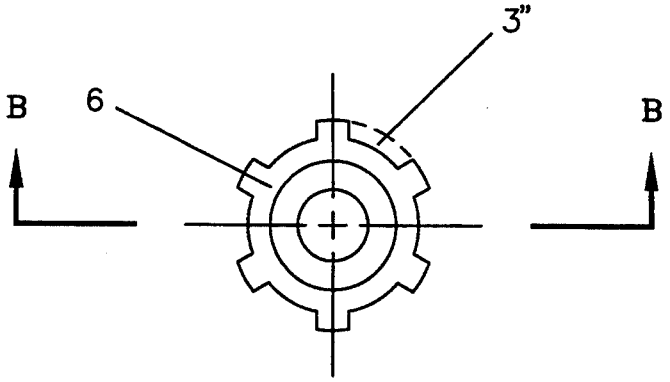
FIG. 6 is a top view of the valve cap.
Figure 7:
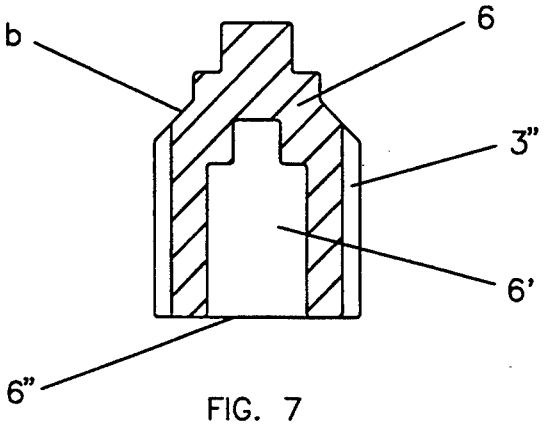
FIG. 7 is a sectional view of the valve cap taken along a line B—B of FIG. 6.

As shown in FIGS. 1 and 2, cap 20 of the present invention comprises an outer cap 1 and an inner cap 2 formed within the outer cap 1. The outer cap 1 and the inner cap 2 are provided with ventilating holes 3 and 3' on the leading ends thereof, respectively. Within the inner cap 2, there is formed a valve room 5, a spring room 4 and valve seat a at an outward angle. A valve cap 6 having longitudinal channels 3'' (as shown in detail in FIGS. 5, 6 and 7) on the outer circumference, a shoulder b formed at the same outward angle as that of the valve seat a, a deep recess 6' and a rear end 6'' is movably installed within the valve room 5 and is actuated by means of a spring 7 disposed in the spring room 4 so that when a writing device 30 comprising a pen body 8, a head portion 8', a leading end 8'', a writing tip 9 and annular step 11 is coupled with the cap 20 the shoulder b of the valve cap 6 is abutted against the valve seat a of the valve room 5. Annular step 2' is formed at the opening portion of the inner cap 2 so as to prevent departure of the valve cap 6 due to spring force of spring 7. When the head portion 8' of writing device 30 is inserted into the outer cap 1, the writing tip 9 is inserted into the deep recess 6' of the valve cap 6 and at the same time the leading end 8'' of the writing device 30 is abutted against the rear end 6'' of the valve cap 6. Furthermore, the annular step 11 of the writing device 30 locks in with lower annular step 10 formed inside the outer cap 1, thereby ensuring a tight closure.

Figure 3:
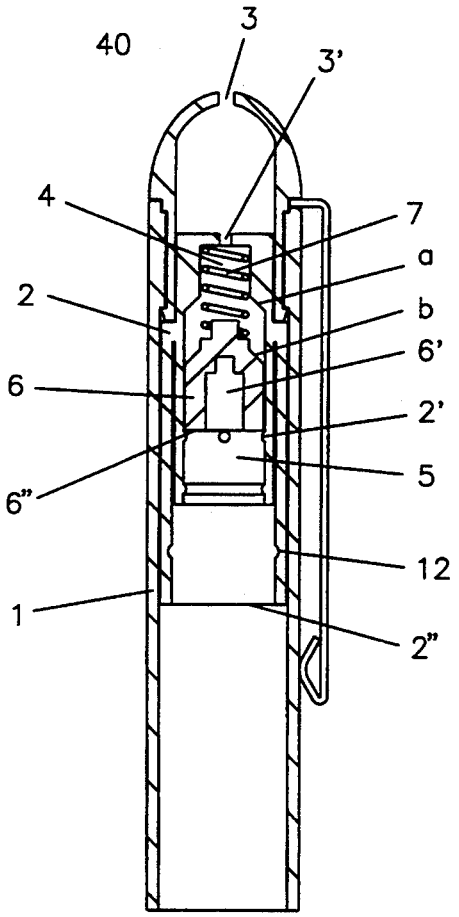
FIG. 3 is a sectional view of the cap showing another embodiment of the cap according to the present invention.
Figure 4:
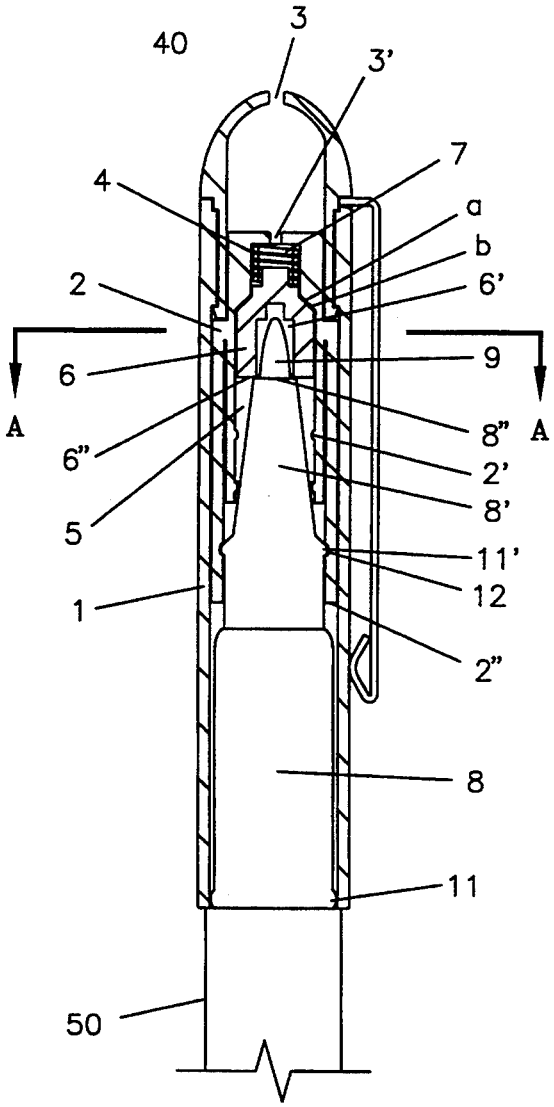
FIG. 4 is a sectional view of the cap showing a state of coupling between the cap of the second embodiment and a writing pen body.

In another embodiment of the present invention as shown in FIGS. 3 and 4, the inner cap 2 of cap 40 is provided separately from the outer cap 1 and a lower end 2'' of the inner cap 2 comes in close contact with the head portion 8' of the writing device 50.

The cap 20 and 40 of the present invention constituted as above will now be described in terms of its action.

As shown in FIG. 1, when the writing device 30 is detached from the cap 20, the valve cap 6 due to spring force of spring 7 is pushed down to the annular step 2' of the inner cap 2 so that the ventilating holes 3, 3' and the longitudinal channels 3'' of the outer cap 1 and the inner cap 2 are opened. When, as shown in FIG. 2, the head portion 8' of the writing device 30 is pushed in to be coupled with the cap 20, the writing tip 9 of the writing device 30 is inserted into the deep recess 6' of the valve cap 6 and the leading end 8'' of the writing device 30 is abutted against the lower end 6'' of the valve cap 6.

Then, as the writing device 30 is further pushed in to be coupled with the cap 20, the valve cap 6 is pushed against the spring 7 and the shoulder b of the valve cap 6 gradually approaches the valve seat a of the valve room 5. This action results in the internal air of the inner cap 2 being discharged through the path formed by ventilating holes 3 and 3'. Therefore, the air within the inner cap 2 is press-discharged through the longitudinal channels 3'' of the valve cap 6 and through the ventilating holes 3 and 3'. When the writing device 30 is completely coupled with the cap 20, the shoulder b of the valve cap 6 is abutted against the valve seat a and at the same time the circumferential surface of the writing pen body 8 is pressed against upper annular step 10' of the outer cap 1. Consequently, the ventilating holes 3 and 3' are closed from the interior of the outer cap 1. Accordingly, there is no pressure step-up within the inner cap 2 and the writing tip 9 is sealed by the inner cap 2 and the valve cap 6 in a dual form to prevent the drying of the ink.

In the other embodiment, as shown in FIG. 4, the writing tip 9 of writing device 50 is not only sealed by the valve cap 6 but also by the annular step 11 of the writing device 50 fitting into the annular groove 12 of the inner cap 2.

Meanwhile, during the process of the separation of the writing device 50 from the cap 40, the valve cap 6 due to the spring force of the spring 7 moves toward the bottom opening of the inner cap 2 along with the writing tip 9 correspondingly with the movement of the writing pen body 8.

At the initial stage of the separation, the shoulder b of the valve cap 6 is momentarily separated from the valve seat a so as to form a gap. Accordingly, the air inside the inner cap 2 and the external air merge with each other through the ventilating holes 3 and 3' so that the internal air pressure of the outer cap 1 would not be decreased. Therefore, when the writing device 50 is separated from the outer cap 1, the ink of the writing device 50 is not evaporation-discharged.

According to the present invention as described above, the ventilating holes 3 and 3' are formed on the leading ends of the outer cap 1 and the inner cap 2, respectively, in a direct line of each other, a valve room 5 is formed within the inner cap 2 and the valve cap 6 is installed movably by means of a spring 7 in such a manner as to open and close the ventilating holes 3 and 3'. Therefore, during the coupling of the writing device 30 (or 50) into the cap 20 (or 40), the ventilating holes 3 and 3' are maintained in an opened state so that the pressure increase within the interior of the cap 20 (or 40) can be prevented. When the writing device 30 (or 50) and the cap 20 (or 40) are completely coupled together, the inner space of the inner cap 2 is maintained in a sealed state, thereby preventing the evaporation and the drying of the ink. At the initial stage of the separation of the writing device 30 (or 50) from the cap 20 (or 40), the ventilating holes 3 and 3' are opened by the valve cap 6 and therefore there occurs no pressure decrease within the inner space of the cap 20 (or 40). Thus the suction discharge of the ink is prevented.

While the present invention has been disclosed with reference to a particular example of preferred embodiment, it is the applicant's intention to cover all modifications and equivalents within the scope of the following appended claims. It is therefore requested that the following claims be given a liberal interpretation which is within the spirit and scope of the applicant's contribution to this art.

What is claimed is:

1. A combination cap and writing device comprising:

(a) said cap comprising:

(1) an outer cap having a ventilating hole formed at leading end thereof, wherein an upper annular step is formed at inside of mid portion of said outer cap, and wherein a lower annular step is formed at inside of trailing end of said outer cap;

(2) an inner cap formed within said outer cap, wherein said inner cap has a ventilating hole formed at leading end thereof, and wherein an annular step is formed at inside of trailing end of said inner cap for preventing the departure of a valve cap;

(3) a spring room formed within said inner cap, wherein said spring room is formed below said ventilating hole of said inner cap;

(4) a valve seat formed within said inner cap, wherein said valve seat is formed below and at an outward angle of said spring room of said inner cap;

(5) a valve room formed within said inner cap, wherein said valve room is formed below said valve seat of said inner cap;

(6) a spring disposed inside said spring room, wherein said spring exerts spring force; and (7) a valve cap disposed inside said inner cap, wherein said valve cap is disposed below said spring, and wherein said valve cap comprises: longitudinal channels formed on outer circumference thereof; a shoulder formed thereof at said outward angle of said valve seat; a deep recess; and a rear end;

(b) a writing device comprising:

(1) a pen body having an annular step;

(2) a head portion having a leading edge, wherein said head portion is connected to said pen body, (3) a writing tip connected at said leading edge of said pen body.

2. A combination cap and writing device comprising:

(a) said cap comprising:

(1) an outer cap having a ventilating hole formed at leading end thereof;

(2) an inner cap formed within said outer cap, wherein said inner cap has a ventilating hole formed at leading end thereof, wherein an annular step is formed at inside of said inner cap for preventing the departure of a valve cap, and wherein an annular groove is formed at inside of said inner cap and below said annular step;

(3) a spring room formed within said inner cap, wherein said spring room is formed below said ventilating hole of said inner cap;

(4) a valve seat formed within said inner cap, wherein said valve seat is formed below and at an outward angle of said spring room of said inner cap;

(5) a valve room formed within said inner cap, wherein said valve room is formed below said valve seat of said inner cap;

(6) a spring disposed inside said spring room, wherein said spring exerts spring force; and (7) a valve cap disposed inside said inner cap, wherein said valve cap is disposed below said spring, and wherein said valve cap comprises: longitudinal channels formed on outer circumference thereof; a shoulder formed thereof at said outward angle of said valve seat; a deep recess; and a rear end;

(b) a writing device comprising:

(1) a pen body having an annular step;

(2) a head portion having a leading edge, wherein said head portion is connected to said pen body, (3) a writing tip connected at said leading edge of said pen body.

3. A combination cap and writing device as set forth in claim 1 or 2, wherein said valve cap is installed to open and close said ventilating hole of said inner cap by said spring force of said spring.

4. A combination cap and writing device as set forth in claim 1 or 2, wherein said valve cap blocks said ventilating hole of said inner cap and said ventilating hole of said outer cap upon coupling of said writing device to said cap thereby preventing pressure variation and evaporation-drying of the ink within said writing tip.

5. A combination cap and writing device as set forth in claim 1 or 2, wherein said valve cap opens said ventilating hole of said inner cap and said ventilating hole of said outer cap upon detaching of said writing device from said cap thereby preventing suction discharge of ink within said writing tip.

* * * * *